US006029777A

United States Patent [19]

Rogelja

[11] Patent Number: 6,029,777

[45] Date of Patent: Feb. 29, 2000

[54] DESCENDER

[76] Inventor: Boris Rogelja, 9 Nelson Avenue, Padstow, NSW 2211, Australia

[21] Appl. No.: 09/171,250

[22] PCT Filed: Mar. 11, 1997

[86] PCT No.: PCT/AU97/00147

§ 371 Date: Jun. 4, 1999

§ 102(e) Date: Jun. 4, 1999

[87] PCT Pub. No.: WO97/33650

PCT Pub. Date: Sep. 18, 1997

[30] Foreign Application Priority Data

Mar. 13, 1996 [AU] Australia ..... PN8642

[51] Int. Cl.[7] ..... A63B 29/00

[52] U.S. Cl. ..... 182/193; 182/192; 182/5; 188/65.5

[58] Field of Search ..... 182/5, 192, 193, 182/191; 188/65.2–65.5

[56] References Cited

U.S. PATENT DOCUMENTS

| | | | |
|---|---|---|---|
| 252,829 | 1/1882 | Williams | 188/65.5 |
| 300,248 | 6/1884 | Green | 188/65.5 |
| 682,869 | 9/1901 | Hammerly | 188/65.5 |
| 899,984 | 9/1908 | Huffman . | |
| 1,242,286 | 10/1917 | Weinandt . | |

*Primary Examiner*—Alvin Chin-Shue
*Attorney, Agent, or Firm*—Browdy and Neimark

[57] ABSTRACT

A descender is disclosed which includes a base plate 10, including first and second sheaves (16, 18) and an arm defining a third sheave 28. The descender also includes means, for biasing the arm to rotate about the pivot away from the base, and stop means for preventing the arm from pivoting further than a predetermined angle away from the base. Further provided are second adjustable stop means for restricting the distance the arm can travel towards the base when the biasing means is overcome and the arm pivoted towards the base. In use, with a rope passing below the first sheave, above and around the third sheave and above the second sheave, the resistance force applied to the rope is a maximum when the arm is pivoted so that the third projection is closest to the longitudinal axis. The descender is operable in two modes:

a first mode in which the descender operates as a descender for controlling the rate of descent of a person sliding down the rope, in which mode the adjustable second stop means can be used to control the rate of descent; and a second mode wherein the descender is used with substantially no tension on the rope passing through the descender as a belay in which mode the biasing means keep the arm and base apart to allow rope to be fed through the descender relatively freely.

8 Claims, 6 Drawing Sheets

DESCENDER

The present application relates to a descender for use in abseiling and belaying and in particular to an improved descender of the type which incorporates a self-acting brake.

Abseiling is a technique used to descend steep surfaces such as cliff faces and is often used by persons involved in activities such as mountain climbing, canyoning and caving. In order to abseil down a cliff face, one end of a rope is made fast at the top of the cliff and the person making descent then slides down the rope. The rope is passed either around the body of the person or, more usually, through a descender attached to a harness worn by the person such that the passage of the rope around the body or through the descender provides sufficient friction to slow the rate of descent to a safe speed.

A descender comprises rope engaging services around and between which the rope travels along a tortuous path, to provide frictional engagement between the rope and the descender. The rate of descent is normally controlled by holding the free or tail end of the rope to control the tension on the rope where it emerges from the descender and thereby to control the degree of friction engagement between the rope and descender which in turn controls the rate of descent.

Descenders used in abseiling vary greatly in performance and complexity, there being a variety of relatively simple devices which rely on frictional engagement between the rope and metal rings or racks about which the rope is wrapped, and a number of more complex descenders which incorporate a braking mechanism which allows friction between the rope and descender to be varied other than by simply controlling the free or tail end of the rope. The earliest of these more complex devices have a handle or lever which when operated tended to increase the friction between the descender and the rope. This type of descender was not a great improvement over the more simple devices as the brake was not self engaging and therefore, if the user was knocked unconscious, he or she would fall in the same way as a user of the earlier devices.

A number of devices now include automatic braking mechanisms in which a handle is operated by a person using descender to control their speed of descent and if the handle is released a brake actuates and prevents a user falling uncontrollably. Australian Patent Application No 16132/95 discloses such a descender which provides an automatic locking system for the descender operated by a lever, in which operation of the lever by a person using descender releases a braking means and allows the person to descend, and in which should the person using descender release the lever, the braking system will automatically apply and prevent the person falling uncontrollably.

A similar type of descender is disclosed in U.S. Pat. No. 4,596,314.

There are two problems associated with the descenders of the type shown in AU 16132/95. The first problem is that the descender cannot be used for belaying. Belaying is a well known technique, used in climbing. A climber (the belayee) will descend or climb a cliff face, or the like, while roped to the cliff face via pitons. A belayer will hold the rope and allow the belayee only as much rope as he or she requires in order to move a short distance up or down the cliff face. Thus, if the belayee falls their fall will be arrested by the rope and the belayer. However, descenders such as that shown in AU 16132/95 cannot be used for belaying.

A second disadvantage of the descender described in AU 16132/95 is that the rate of descent cannot be preselected by a person using the device as a descender.

It is an object of the present invention to alleviate one or more of the abovementioned disadvantages.

Thus, according to the present invention there is provided a descender for use in abseiling, or belaying, comprising:

a base having a connection means for connecting the descender to a harness or the like;

an arm pivotally mounted on the base at a pivot axis extending generally normal to the base;

the base having first and second spaced projections for engaging a rope, the projections both extending generally parallel to the pivot axis;

the arm having a third projection for engaging a rope, the projection extending generally parallel to the pivot axis, the projection being located so that when the arm is pivoted towards the base the projection is located to one side of a longitudinal axis passing through the first and second spaced projections on the base and is spaced further from the pivot axis than the second projection, but closer to the pivot axis than the first projection, characterised by;

means, for biasing the arm to rotate about the pivot away from the base, and stop means for preventing the arm from pivoting further than a predetermined angle away from the base; and second stop means for restricting the distance the arm can travel towards the base when the biasing means is overcome and the arm pivoted towards the base, said second stop means being adjustable a retention plate, the arrangement being such that, in use, with a rope passing below the first projection, above and around the third projection and above the second projection, the resistance force applied to the rope is a maximum when the arm is pivoted so that the third projection is closest to the longitudinal axis, the descender being operable in two modes:

a first mode in which the descender operates as a descender for controlling the rate of descent of a person sliding down the rope, in which mode the adjustable second stop means can be used to control the rate of descent; and a second mode wherein the descender is used as a belay with substantially no tension on the rope passing through the descender, such that rope can be fed through the descender, in which mode the biasing means keep the arm and base apart to allow rope to be fed through the descender relatively freely, but in which mode sudden increases in tension in the rope, cause the biasing means to be overcome and the pivot arm to be pulled towards the base thus locking the rope between the first and second projections and preventing uncontrolled descent.

Thus, the present invention provides a descender which can be used either as a belay or as a descender.

When used as a belay the device allows a rope to run freely through it provided that movements are slow. If the rope starts to move quickly through the descender which would happen if the belayee fell, the arm is pulled towards the base and the device automatically locks. When used as a descender, the adjustable second stop means can be used to control rate of descent.

The automatic braking occurs when pressure is placed on the rope between fixed end sheaves (defined by the first and second projections) and the pivotable centre sheave, defined by the third projection.

In a preferred embodiment, the biasing means comprise a spring acting on a protrusion defined on the arm and the stop means is a catch defined on the base, the catch being movable to allow the descender to be opened.

In one embodiment, the adjustable stop means comprises:

a lever pivoted on the base, said lever being associated with a cam and defining a cam surface;

a cam follower being located on the arm, said cam and cam surface being configured such that when the cam is positioned at either end of the cam surface, the arm can pivot closer to the base than when the cam is in a more central location on the cam surface than when the cam is located at either end of the cam follower, so that in use the resistance force applied to the rope is a maximum when the cam is disposed at or close to either end of the cam surface and a minimum when the cam is disposed between the ends of the cam surface, such that by manipulating the lever the resistance to movement may be set by locating the cam on a particular area on the cam follower and wherein if the handle is not locked in position, sudden movements of the rope through the descender cause the pivot arm to be pulled towards the base thus locking the rope between the first and second projections the lever is lockable in position. This allows the rate of descent to be preset.

In a preferred embodiment, the lever includes an extension arm which is hinged to the lever which can be folded to the lever for storage and extended for use to increase the effective length of the lever.

In an alternative embodiment, the adjustable stop means comprise a stop defined on the base and a threaded rod defining an end which end is arranged to abut the stop when the arm is pivoted towards the base, the rod being mounted in an internally threaded block fixed to the arm so that turning the rod when the end abuts the stop, causes the end to move and hence causes the arm to move relative to the base.

BRIEF DESCRIPTION OF THE DRAWINGS

The invention will now be described, by way of example only, and with reference to the accompanying drawings, in which.

DETAILED DESCRIPTION OF PREFERRED EMBODIMENTS

Figure 1:
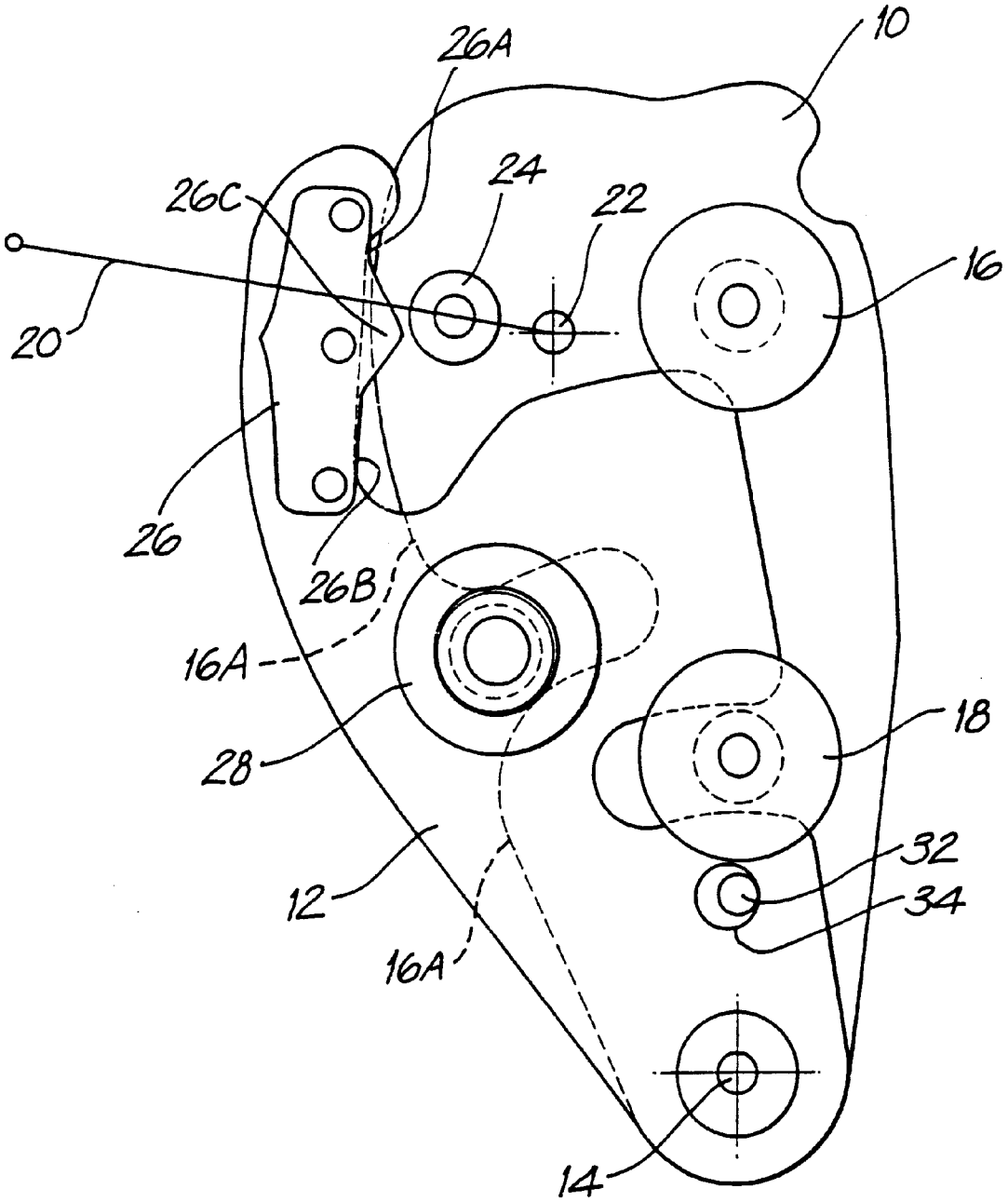
FIG. 1 is a schematic plan view of a first embodiment of a descender, with a retention plate removed.

Referring to the drawings, FIG. 1 is a plan view of a first embodiment of a descender which includes a base plate 10 and an arm 12. In FIG. 1, the parts, 16A of the outer edge of the base plate which are hidden from view by the arm, are shown in phantom, as are parts of the perimeter of the arm which are hidden from view by sheaves.

The arm 12 is mounted above the base plate by means of a pivot 14, so that the arm is free to rotate relative to the base plate about that pivot. First and second spaced sheaves, 16 and 18, respectively, are mounted on the base plate. The sheaves are non-rotatable. The sheaves are configured so that parts of the arm 12 can be interposed below the sheaves, between the sheaves and the base 10, as will be explained later with particular reference to FIG. 2A.

Figure 1A:
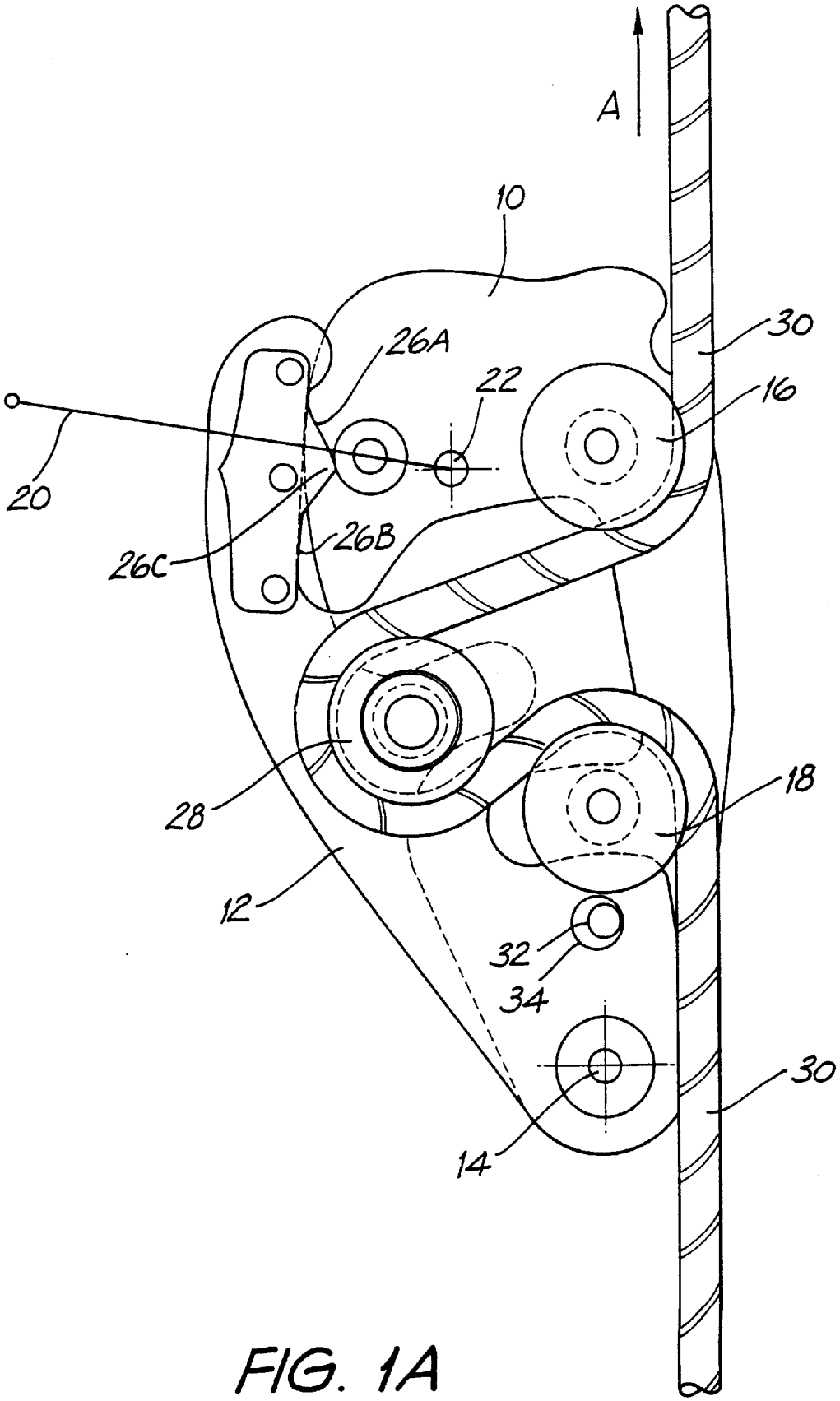
FIG. 1A is a plan view similar to that of FIG. 1, which illustrates a rope passing through the descender of FIG. 1.

A lever 20 is also mounted to the base plate by means of a pivot 22. In FIGS. 1 and 1A, the lever is represented by line 20, to avoid obscuring other components of the descender. A cylindrical bearing 24 which defines a cam, is attached to the lever 20, adjacent the pivot. A cam surface/cam follower 26 is riveted to the arm. When the cam 24 is in contact with the cam surface 26, pivoting the lever 20 about the pivot 22 moves the bearing surface 24 relative to the cam surface 26 and the arm is, in consequence, moved about the pivot 14, to move the arm towards, or away from, the base 10. Consequently sheave 28, which is mounted on the arm 12, moves towards, or away from, sheave 18. As can be seen in FIG. 1, the centre 26C of the cam surface 26, is closer to the pivot 22, than the ends 26A, 26B of the cam surface. Thus when the cam is located at the centre of the cam surface 26C, the arm 12 is further away from the base than when the cam moves to either end 26A or 26B of the cam surface.

A spring and stop arrangement, not illustrated in FIG. 1, is provided which acts on sheave 28 to cause the sheave to move away from sheaves 16 and 18, which in turn causes the arm to rotate anti-clockwise, as illustrated, about pivot 14, away from the base, with the stop preventing arm 12, and hence sheave 28 from moving more than a predetermined angle about the pivot 14 away from the base 10. Thus, in the absence of any other forces, the arm will be held at a predetermined angle relative to/distance from, the base.

The arm can be locked to the base plate 10 by passing a bolt, or similar device, through small, aligned, holes 30 and 32 in the base plate and retention plate respectively and larger hole 34 in the arm which allows limited movement of the arm about the pivot. This feature is particularly useful if children are using the descenders to prevent them being opened in use which would be dangerous.

FIG. 1A shows similar a view to FIG. 1 but in which a rope 30 has been threaded through the descender. The descender is shown as it would be oriented in use when attached to a persons harness, attachment means for doing this normally being provided close to the pivot pin 14. Tension in the rope caused by the weight of the person attached to descender tends to pull the spool 28 towards spool 16 thus compressing the rope between spools 16 and 28 and slowing the rate of descent. Moving the lever 20 to cause the cam 24 to move away from either end 26A or end 26B of the cam follower towards the centre 26C of the cam follower, forces the arm 12 to move away from the base 10 thus increasing the distance between sheaves 18 and 28 and allowing the rope to pass more freely between the spools, thus increasing the rate of descent. The rate of descent can thus be controlled by the lever 20. The fact that the central position of the lever 26C provides the fastest rate of descent makes the device inherently safe, since once the lever is above or below the centre 26C the speed of descent is automatically reduced regulating a safe descent rate If the lever is accidentally knocked the likelihood is that it will be knocked, towards one of the ends thus slowing the rate of descent.

The device can also be used as a belay for use in descending or ascending a mountain, cliff face or the like in which case part of the rope will be securely attached to a mountain or cliff face and a person also attached to the rope, the belayer, will feed a limited amount of rope to the belayee as the belayee climbs up or down. The belayer, who may be on the cliff face above or below the belayee or standing at the top or bottom of the cliff face, wears the descender attached to a harness. The spring and stop mechanism keeps the arm 12 apart from the base 10, thus keeping sheaves 28 and 16 apart and allowing the rope to run relatively freely through the descender so that rope is supplied as the belayee/climber requires it hence the belayee can climb freely. If the belayer is also on the cliff face the belayer does not need to use their hands to feed rope to the belayee and can use both hands to grip the cliff face. If the belayer falls the increased tension in the rope will easily overcome the biasing spring and the arm will move towards the base to slow, and regulate, the rate of descent.

To lower the belayee, the belayer can simply operate the lever 20 to control the descent of the belayee.

The device can also be used to lower objects or people down cliffs controlled from the bottom of the cliff by turning the device upside down so that in FIG. 1*a* the arrow A will be pointing to the ground and applying tension to the lower end of the rope to pull spool 28 towards spool 18 to slow the rate of descent of the object or person when required.

Having described the general features and principal of operation of the descender, some specific features of the descender particularly relating to the construction of the descender will now be described in more detail with reference to FIGS. 2 to 5.

Figure 2:
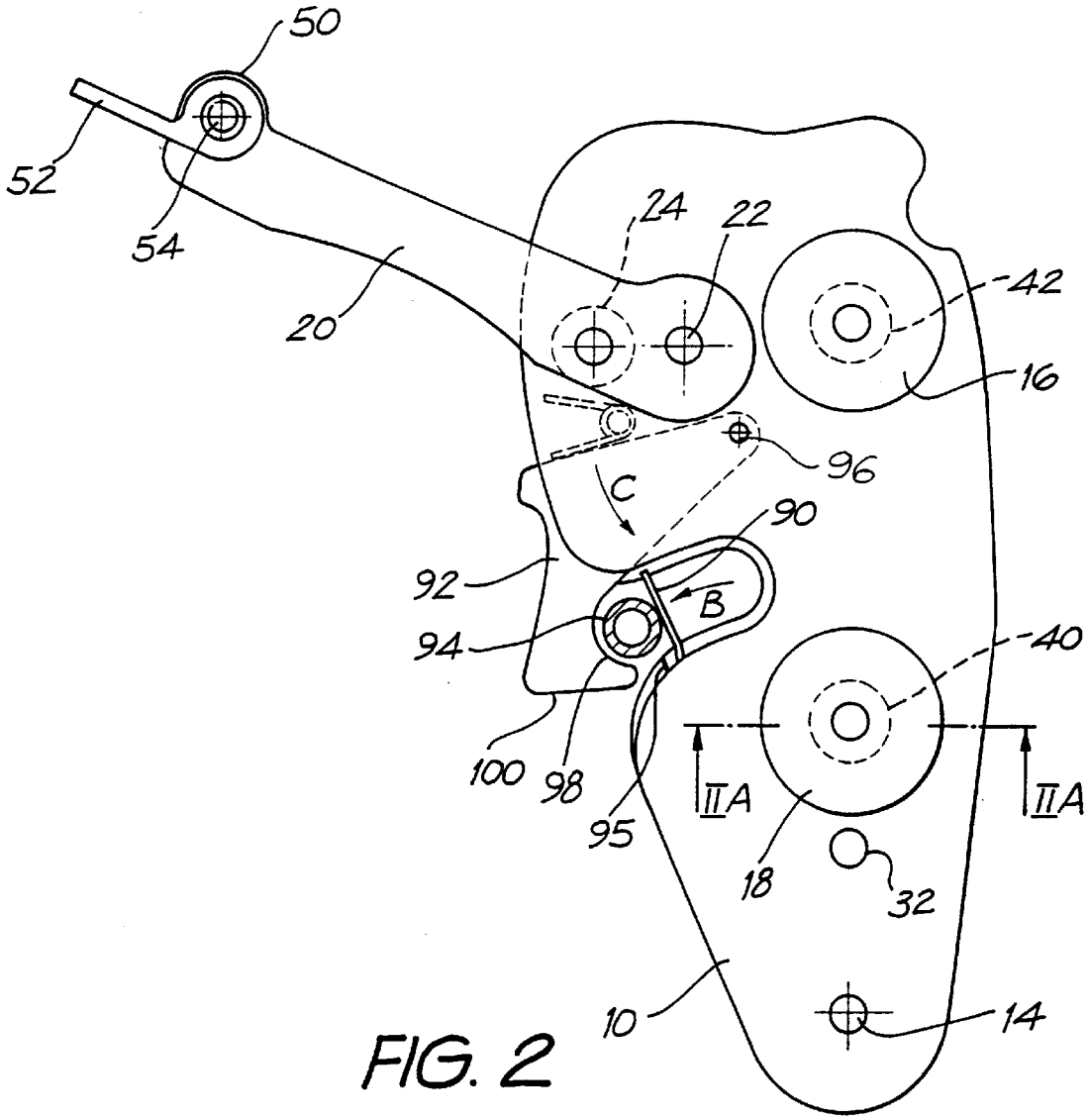
FIG. 2 illustrates a base plate of the descender and a number of components associated with, or attached to, that base plate.
Figure 2A:
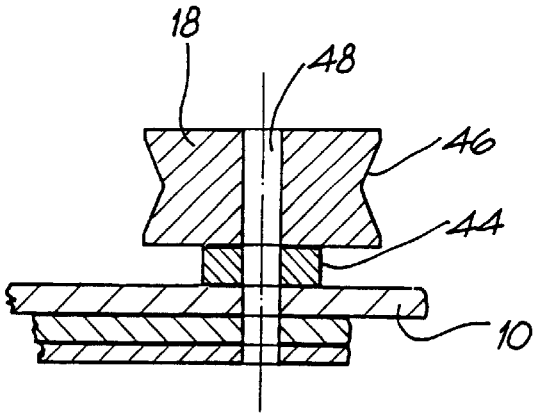
FIG. 2A is a cross-sectional view along line IIA—IIA of FIG. 2.

FIG. 2 shows a base plate 10 with sheaves 16 and 18 and lever 20 attached. As can be seen from FIG. 2 and FIG. 2A the spools are generally circular in plan view having a reduced diameter portion 44 adjacent the base 10, and a wider cylindrical part 46 whose sides define a shallow V-shaped profile or channel 46. The cut out portion 44 allows parts of the arm 12 to pass under the main part of the sheave 46. The V shaped profile/channel of the wider part of the sheave 46 is configured to receive the rope 30. As shown in FIG. 2A the sheave includes a central longitudinal bore 48 which can receive a rivet or the like to secure the sheave between the base plate 10 and the retention plate, not shown in FIG. 2A.

FIG. 2 also shows that one end of the lever 50 has an extension portion 52 mounted to it which can be rotated about pivot 54 to extend the effective length of the lever.

Also shown in FIG. 2 is a spring and stop means assembly for biasing the arm for belaying, and for "opening" and "closing" the descender. The spring and stop means assembly comprises a spring 90, and a catch 92 which are mounted on the underside of the base 10 and a rod 94 which depends from the lower face of the arm 12. The spring is a resilient length of springy steel which is fixed to the base, pushes against a stop 95, and when pushed away from the stop 95 by rod 94, acts to push rod 94 anti-clockwise about pivot 96 on which the catch is mounted, in the direction of the arrow B. The catch is mounted on the underside of base 10, and partly covered by a plate 115, seen in FIG. 4. It is lightly biased to turn in the direction of the arrow C. The inside surface 98 of the catch is configured with a curve of a short radius so as to retain the rod, so that if the rod is pushed in the direction B the catch will not move. To move the catch it is necessary to push on surface 100. That arrangement prevents the descender from accidentally springing open. The descender is opened to allow rope to be fed into the descender and around sheave 28, for use.

The configuration of the surface 100 and location of pivot 96 are such that as the arm is closed, rod 94 pushes the catch clockwise about pivot 96 to open the catch automatically.

Figure 3:
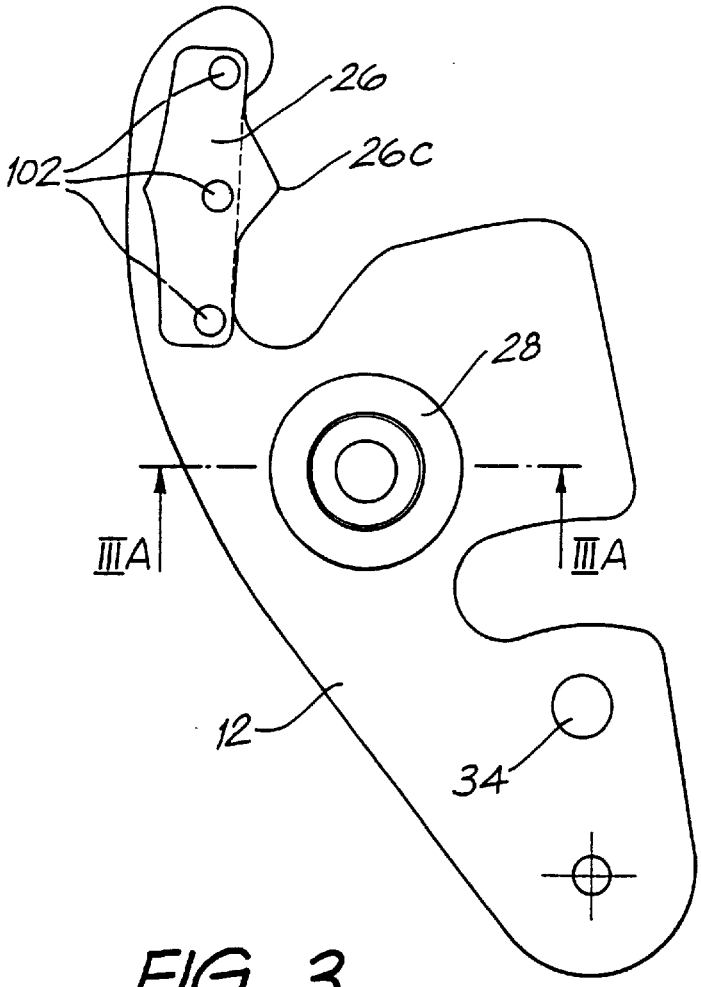
FIG. 3 illustrates an arm of the descender.

FIG. 3 shows the arm 12 in more detail, and in particular shows the cam follower 26 which is a piece of hardened steel secured to the arm by means of three rivets 102.

Figure 3A:
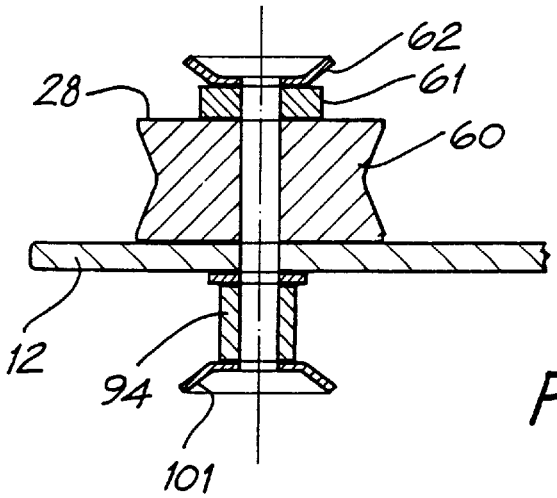
FIG. 3A is a cross-sectional view on line IIIA—IIIA of FIG. 3.

FIG. 3A shows the sheave 28 in more detail. The major part 60 of the sheave adjacent the arm 12 is generally cylindrical with the sides of the cylinder having a generally V-shaped profile 60 thus defining a shallow channel to receive the rope. The upper part of the sheath 61 defines a cylindrical portion having a reduced diameter compared to the major part of the sheath which is adapted to locate in a cut out portion of the retention plate to allow the arm and base to close together when assembled. The uppermost part of the sheave defines a wider flange portion 62. On the opposite side of the arm to the sheave is cylindrical rod 94, which terminates in a flange 101.

Figure 4:
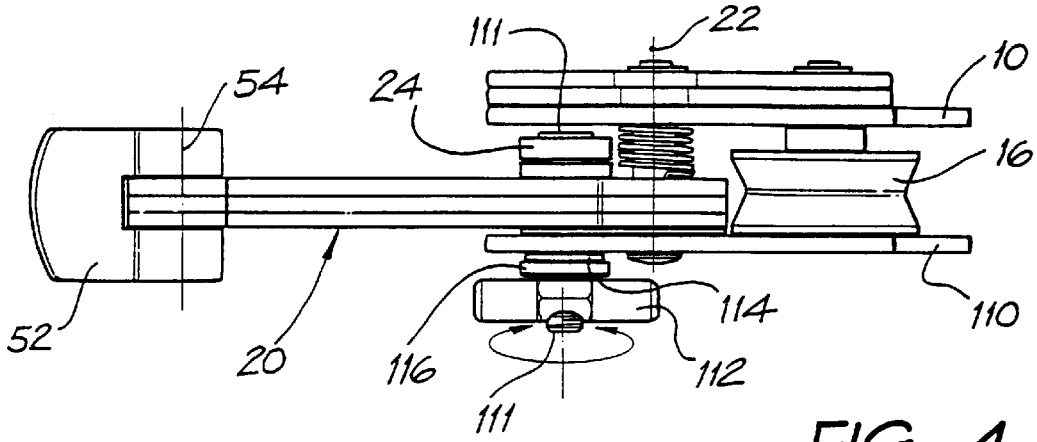
FIG. 4 is an end view of a lever of the descender and associated components.

FIG. 4 shows an end view of the descender illustrating the lever 20 sandwiched between base plate 10 and a retention plate 110. The lever is formed from three sheets of steel sandwiched together although the lever could be made in one piece. In particular, FIG. 4 shows the cam 24 disposed on the underside of the handle as oriented in FIG. 4. The pivot axis 22 of the lever is defined by a rivet/bolt. The cam 24 is disposed on the lower end of a threaded bolt 111. The bolt passes through the lever 20 and a crescent shaped aperture in the retention plate, seen in FIG. 5. A wing nut 112 is mounted on the upper end of the bolt 111. Between the wing nut and the upper surface of the retention plate, there is a metal washer 116 and a leather washer 114. The wing nut can be tightened on the rod to compress the leather washer between the nut 112 and the plate 110, and lock the lever to prevent the same from moving.

Figure 5:
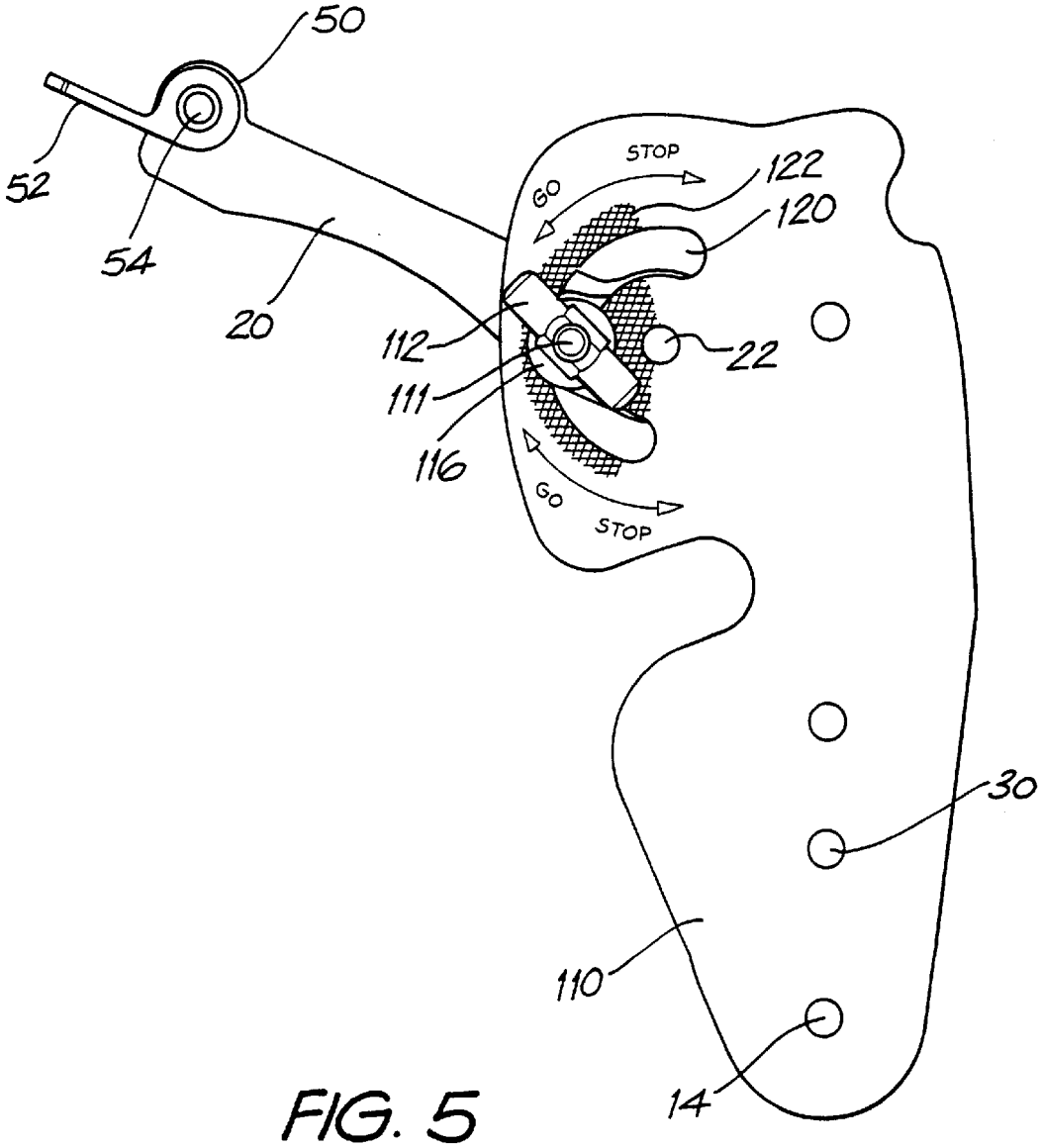
FIG. 5 shows a retention plate and the lever of FIG. 4.

Referring now to FIG. 5, which illustrates the retention plate 110, and lever in particular, omitting other features, an arcuate cut out portion 120 is defined in the retention plate through which the threaded rod 111 extends such that the lever can be locked in position anywhere on the arc 120. A roughened portion 122 exists around the cut out 120 to improve the grip of the leather washer on the plate 110.

Because the lever can be locked in position the rate of descent can be preset by an operator. The preset rate of descent can be overridden by operation of the lever.

The spring and stop arrangement allow the descender to be used for belaying by keeping the arm and base apart and preventing locking of the rope when movement of the rope through the descender is slow.

Figure 6:
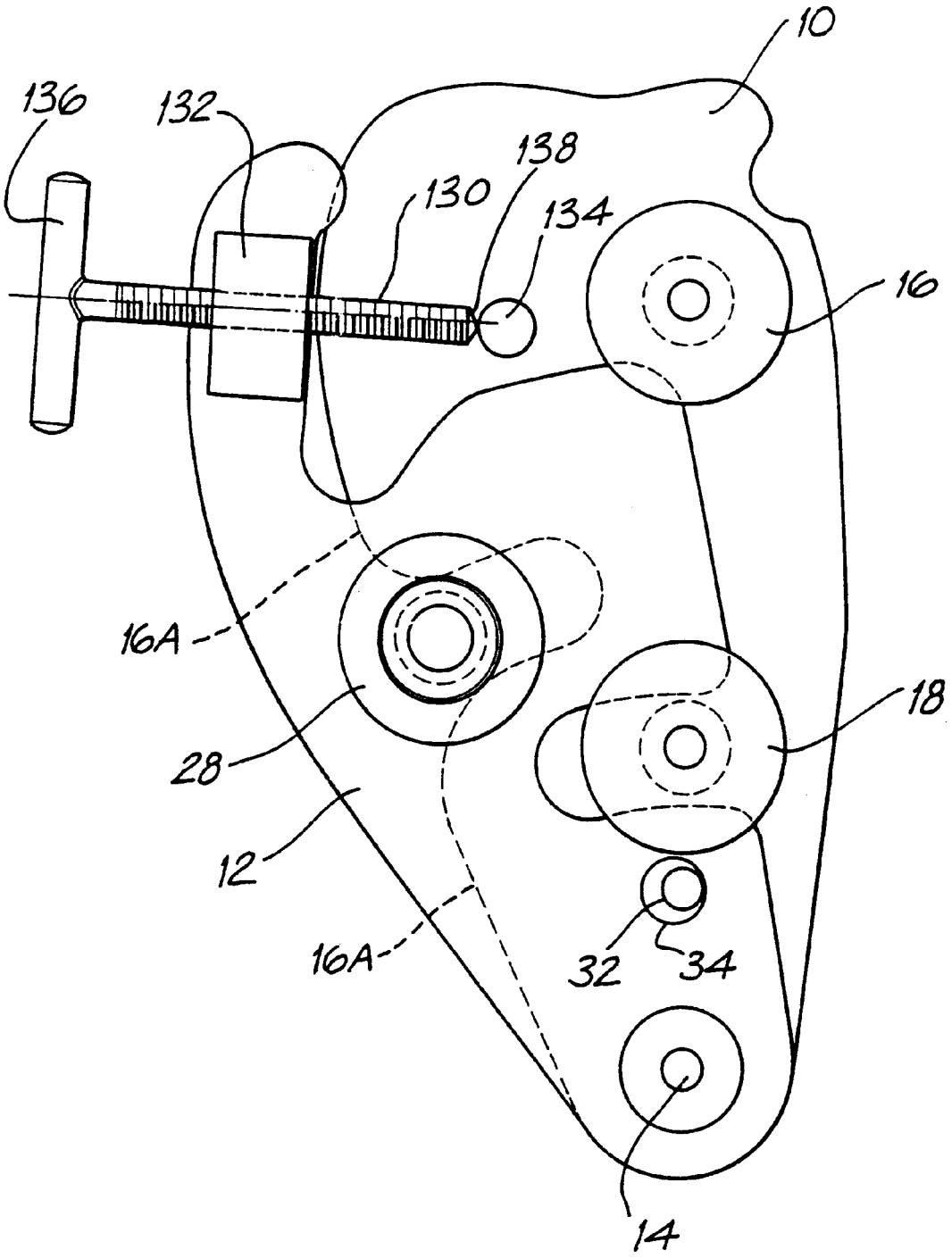
FIG. 6 illustrates a second embodiment of the present invention.

FIG. 6 illustrates an alternative embodiment in which the lever and cam/cam surface arrangement shown in FIG. 1 is replaced with a threaded rod 130 mounted in a threaded block 132 on the arm 12 and a cooperating stop 134 mounted on the base 10. Turning a handle 136 on the rod moves end 138 of the rod. Thus the handle can be used to preset an angle between arm 12 and base 10 when the end 138 contacts the stop 134. This embodiment is in all other respects the same as the first embodiment, except that no arcuate slot 120 is provided in the retention plate 110.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A descender for use in abseiling, or belaying, comprising:

a base having a connection means for connecting the descender to a harness;

an arm pivotally mounted on the base at a pivot axis extending generally normal to the base;

the base having first and second spaced projections for engaging a rope, the projections both extending generally parallel to the pivot axis;

the arm having a third projection for engaging a rope, the third projection extending generally parallel to the pivot axis, the third projection being located so that when the arm is pivoted towards the base the third projection is located to one side of a longitudinal axis passing through the first and second spaced projections on the base and is spaced further from the pivot axis than the second projection, but closer to the pivot axis than the first projection, characterised by;

biasing means, for biasing the arm to rotate about the pivot away from the base, and stop means for preventing the arm from pivoting further than a predetermined angle away from the base; and second stop means for restricting the distance the arm can travel towards the base when the biasing means is overcome and the arm pivoted towards the base, a retention plate, whereby in use said descender being operable with a rope passing below the first projection, above and around the third projection and above the second projection, a resistance force applied to the rope is a maximum when the arm is pivoted so that the third projection is closest to the longitudinal axis, the descender being operable in two modes:

a first mode in which the descender operates as a descender for controlling the rate of descent of a person sliding down the rope, in which mode the second stop means can be used to control the rate of descent; and a second mode wherein the descender is used with substantially no tension on the rope passing through the descender as a belay such that rope can be fed through the descender, in which mode the biasing means keep the arm and base apart to allow rope to be fed through the descender relatively freely but in which mode sudden increases in tension in the rope, cause the biasing means to be overcome and the pivot arm to be pulled towards the base thus locking the rope between the first and second projections and preventing uncontrolled descent.

2. A descender as claimed in claim 1, characterised in that the biasing means comprise a spring acting on a protrusion defined on the arm and the stop means is a catch defined on the base, the catch being movable to allow the descender to be opened.

3. A descender as claimed in claim 1, characterised in that the second stop means comprises:

a lever pivoted on the base, said lever being associated with a cam and defining a cam surface; and a cam follower being located on the arm, said cam and cam surface being configured such that when the cam is positioned at either end of the cam surface, the arm can pivot closer to the base than when the cam is in a more central location on the cam surface than when the cam is located at either end of the cam follower, so that when operable the resistance force applied to the rope is a maximum when the cam is disposed at or close to either end of the cam surface and a minimum when the cam is disposed between the ends of the cam surface, such that by manipulating the lever the resistance to movement may be set by locating the cam on a particular area on the cam follower and wherein if the handle is not locked in position, sudden movements of the rope through the descender cause the pivot arm to be pulled towards the base thus locking the rope between the first and second projections.

4. A descender as claimed in claim 3 characterised in that locking means are provided to lock the lever in position so that a rate of descent can be preset.

5. A descender as claimed in claim 4 characterised in that the lever includes an extension arm which is hinged to the lever and can be folded to the lever for storage and extended for use to increase the effective length of the lever.

6. A descender as claimed in claim 1 characterised in that the second stop means comprise a stop defined on the base and a threaded rod defining an end which end is arranged to abut the stop when the arm is pivoted towards the base, the rod being mounted in an internally threaded block fixed to the arm so that turning the rod when the end abuts the stop, causes the end to move and hence causes the arm to move relative to the base.

7. A descender for use in abseiling, or belaying, comprising:

a base having a connection means for connecting the descender to a harness;

an arm pivotally mounted on the base at a pivot axis extending generally normal to the base;

the base having first and second spaced projections for engaging a rope, the projections both extending generally parallel to the pivot axis;

the arm having a third projection for engaging a rope, the third projection extending generally parallel to the pivot axis, the third projection being located so that when the arm is pivoted towards the base the third projection is located to one side of a longitudinal axis passing through the first and second spaced projections on the base and is spaced further from the pivot axis than the second projection, but closer to the pivot axis than the first projection, characterised by;

a protrusion defined on the arm and a spring means acting on the protrusion for biasing the arm to rotate about the pivot away from the base, and a stop means comprising a catch defined on the base for preventing the arm from pivoting further than a predetermined angle away from the base, the catch being pivotable to allow arm of the descender to be moved beyond the predetermined angle and second stop means comprising a stop defined on the base and a threaded rod defining an end which end is arranged to abut the stop when the arm is pivoted towards the base, the rod being mounted in an internally threaded block fixed to the arm so that turning the rod when the end abuts the stop causes the arm to move relative to the base, said second stop means restricting the distance the arm can travel towards the base when the biasing means is overcome and the arm is pivoted towards the base, a retention plate, whereby in use said descender being operable, with a rope passing below the first projection, above and around the third projection and above the second projection, a resistance force applied to the rope is a maximum when the arm is pivoted so that the third projection is closest to the longitudinal axis, the descender being operable in two modes:

a first mode in which the descender operates as a descender for controlling the rate of descent of a person sliding down the rope, in which mode the adjustable second stop means can be used to control the rate of descent; and a second mode wherein the descender is used with substantially no tension on the rope passing through the descender as a belay such that rope can be fed through the descender, in which mode the biasing means keep the arm and base apart to allow rope to be fed through the descender relatively freely but in which mode sudden increases in tension in the rope, cause the biasing means to be overcome and the pivot arm to be pulled towards the base thus locking the rope between the first and second projections and preventing uncontrolled descent.

8. A descender for use in abseiling, or belaying, comprising:

a base having a connection means for connecting the descender to a harness;

an arm pivotally mounted on the base at a pivot axis extending generally normal to the base;

the base having first and second spaced projections for engaging a rope, the projections both extending generally parallel to the pivot axis;

the arm having a third projection for engaging a rope, the third projection extending generally parallel to the pivot axis, the third projection being located so that when the arm is pivoted towards the base the third projection is located to one side of a longitudinal axis passing through the first and second spaced projections on the base and is spaced further from the pivot axis than the second projection, but closer to the pivot axis than the first projection, characterised by;

a protrusion defined on the arm and a spring means acting on the protrusion for biasing the arm to rotate about the pivot away from the base, and a stop means comprising a catch defined on the base for preventing the arm from pivoting further than a predetermined angle away from the base, the catch being pivotable to allow arm of the descender to be moved beyond the predetermined angle and a second stop means, a retention plate, whereby in use said descender being operable, with a rope passing below the first projection, above and around the third projection and above the second projection, a resistance force applied to the rope is a maximum when the arm is pivoted so that the third projection is closest to the longitudinal axis, the descender being operable in two modes:

a first mode in which the descender operates as a descender for controlling the rate of descent of a person sliding down the rope, in which mode the second stop means can be used to control the rate of descent; and a second mode wherein the descender is used with substantially no tension on the rope passing through the descender as a belay such that rope can be fed through the descender, in which mode the biasing means keep the arm and base apart to allow rope to be fed through descender relatively freely but in which mode sudden increases in tension in the rope, cause the biasing means to be overcome and the pivot arm to be pulled towards the base thus locking the rope between the first and second projections and preventing uncontrolled descent and wherein the second stop means comprising:

a lever pivoted on the base, said lever being associated with a cam and defining a cam surface; and a cam follower being located on the arm, said cam and cam surface being configured such that when the cam is positioned at either end of the cam surface, the arm can pivot closer to the base than when the cam is in a more central location on the cam surface than when the cam is located at either end of the cam follower, so that in use the resistance force applied to the rope is a maximum when the cam is disposed at or close to either end of the cam surface and a minimum when the cam is disposed between the ends of the cam surface, such that by manipulating the lever the resistance to movement may be set by locating the cam on a particular area on the cam follower and wherein if the handle is not locked in position, sudden movements of the rope through the descender cause the pivot arm to be pulled towards the base thus locking the rope between the first and second projections.

* * * * *